United States Patent [19]

McPhee et al.

[11] 4,314,614

[45] Feb. 9, 1982

[54] METHOD AND APPARATUS FOR DISARMING AND ARMING EXPLOSIVE OIL WELL PERFORATORS

[75] Inventors: William A. McPhee; Timothy G. Golian, both of Houston, Tex.

[73] Assignee: Dresser Industries, Inc., Dallas, Tex.

[21] Appl. No.: 154,652

[22] Filed: May 30, 1980

[51] Int. Cl.[3] ..... E21B 43/118

[52] U.S. Cl. ..... 175/4.56; 166/55.1; 102/260; 102/320; 102/331

[58] Field of Search ..... 166/55.1, 294; 175/4.5, 175/4.51, 4.52; 123/20, 21, 21 C, 29 HC, 254, 244, 221, 260

[56] References Cited

U.S. PATENT DOCUMENTS 2,355,979 8/1944 Keyzer ..... 4/295
4,011,815 3/1977 Garcia ..... 166/55.1
4,042,202 8/1977 Molinari ..... 403/379
4,172,421 10/1979 Regalbuto ..... 102/260

*Primary Examiner*—William F. Pate, III
*Attorney, Agent, or Firm*—Richard Byron; Patrick H. McCollum

[57] ABSTRACT

An improved safe-arm method and apparatus is provided for preventing unwanted detonation of shaped charge perforating guns while in storage and in transport, yet providing quick and easy arming at the well site. An interrupter member is inserted within an air gap between an ignitor section and an explosive charge section. To ready the perforating gun for use, a lanyard connected to the interrupter and extending externally from the perforating gun housing is pulled, removing the interrupter from the gap and arming the perforating gun section.

2 Claims, 2 Drawing Figures

METHOD AND APPARATUS FOR DISARMING AND ARMING EXPLOSIVE OIL WELL PERFORATORS

BACKGROUND OF THE INVENTION

This invention relates to improved methods and apparatus for safe-arm devices, and more particularly to methods and apparatus for disarming and arming oil well perforating instruments.

It has become common practice in the completion of oil and gas wells to perforate the well casing to bring the well into production by the utilization of detonating explosives of high velocity and of the general character and form known as "shaped charges", as for example, the type described in U.S. Pat. No. 2,399,211, issued to C. O. Davis et al.

In the operation of a shaped charge perforator gun, a tubular gun body containing a plurality of charges is lowered into the wellbore. The gun is positioned opposite the subsurface formation to be perforated. A current is passed from the surface through the blasting cap thereby causing explosion of the cap. The exploding blasting cap ignites a primacord which in turn causes the shaped charge to detonate. The detonated shaped charges forms a hot stream of high pressure gasses and high velocity particles, or a so called "jet", which perforates the well casing and subsurface formation.

Due to the explosive and dangerous nature of shaped charges perforating guns, when in storage or shipment the blasting cap must be segregated from the shaped charge perforating gun. In the past only by such segregation could one be assured that the perforating gun would not be accidentally fired by spurious ignition of the blasting cap due to physical shock or static electricity. Abiding by the segregation of shaped charge from blasting cap results in the necessity of assembling the perforating gun once it arrives at the well site. Due to the adverse conditions of the oil field, the technical complexities involved and the time limitations of such an operation, well site assemble has proven impractical.

These and other disadvantages are overcome with the present invention by providing method and apparatus for reliably disarming shaped charged perforating guns while in storage and shipment yet providing a simple and easy means for arming the device at the well site.

SUMMARY OF THE INVENTION

In the preferred embodiment of the invention, an oil well perforating device is provided which, in its overall concept includes a plurality of housing sections joined together to form a perforating gun. Each housing section contains a shaped charge, a primacord and a blasting cap. The blasting cap is comprised of an ignitor section and an explosive charge section.

In the operation of the blasting cap, an electrical current is passed through a wire in the ignitor section causing a flame of intense heat to be collimated onto the explosive charge section. The detonation of the explosive charge section ignites the primacord which in turn detonates the shaped charge resulting in the perforation of an adjacent formation.

The blasting cap is provided with an air gap separating the ignitor section from the explosive charge section of the cap. To prevent spurious detonation of the explosive charge section of the blasting cap during storage or shipment of the perforating device an interrupter is inserted within the air gap. The interrupter will prevent any ignition flame from striking the explosive charge section thereby rendering the perforating device in a safe mode. Further, the interrupter is impregnated with a temperature sensitive material which will desensitize the explosive charge section when a blasting is exposed to abnormally high temperature such as an open flame.

To provide easy arming of the perforating gun, a lanyard or wire cord is attached to one end of the interrupter and passed through a small hole to the exterior of the perforating gun. When it is desired to arm the perforating gun, the lanyard is pulled thereby removing the interrupter from its location between the ignition section and the explosive charge section of the blasting cap. When all the sections of the shaped charged perforating instrument are rendered armed it is ready to be lowered into the wellbore for normal perforating operations.

Accordingly, it is a feature of the present invention to provide method and apparatus for disarming and arming explosive oil well perforators.

It is another feature of the present invention to provide method and apparatus to prevent uncontrolled ignition of a blasting cap within a perforating gun.

It is yet another feature of the present invention to provide method and apparatus for interrupting the ignition flame within a blasting cap.

Another feature of the present invention includes method and apparatus for disarming an oil well shaped charge perforating device while in storage or in transit yet providing an easy and simple method of arming the device at the well site.

It is yet another feature of the present invention to provide method and apparatus for desensitizing the explosive charge section of the blasting cap to prevent undesired detonation due to exposure to abnormally high temperatures.

These and other features and advantages of the present invention can be understood from the following description of the techniques of producing the invention described in conjunction with the following drawing:

DETAILED DESCRIPTION OF THE DRAWING

Figure 1A:
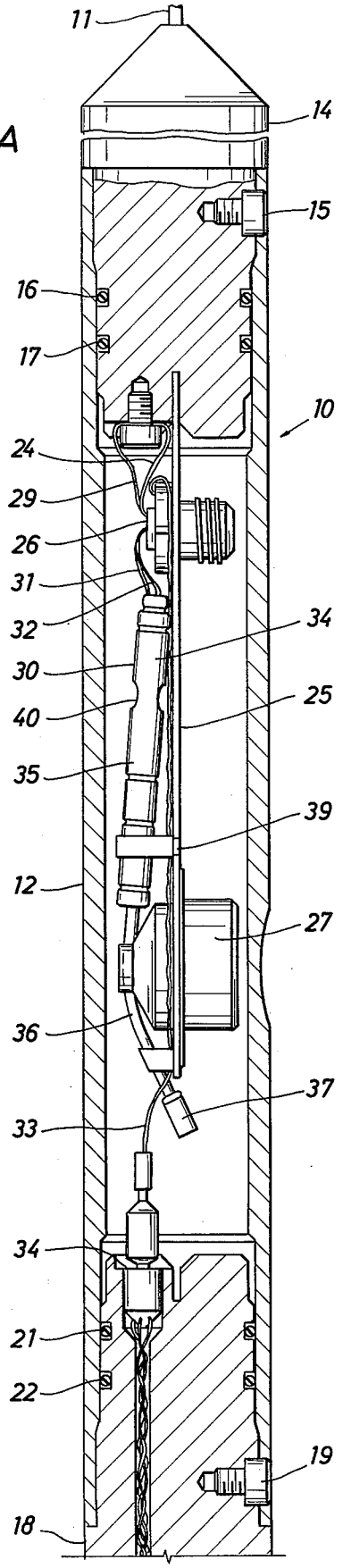
FIG. 1A is a schematic representation partially cutaway of the upper portion of a jet perforating device in accordance with the present invention.
Figure 1B:
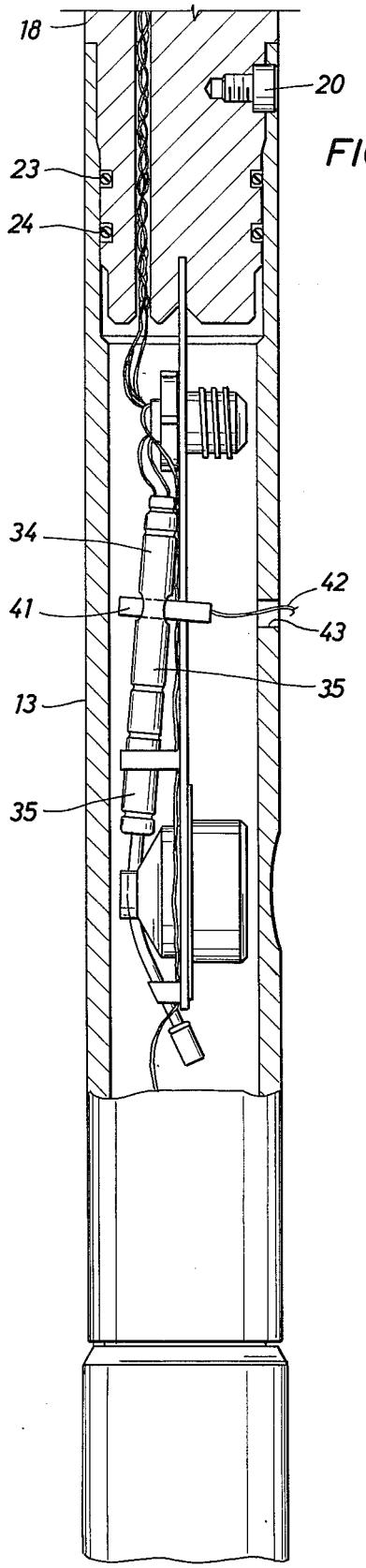
FIG. 1B is the lower portion of the device shown in FIG. 1A.

Referring now to the drawing in more detail, there is illustrated a portion of a jet perforating gun 10 which can be raised or lowered into position within a well by means of a suitable cable 11 designed to carry the electrical current from a surface location to various locations within perforating gun 10. Perforating gun 10 is comprised of a number of identical shaped charge sections, illustrated by upper section 12 and lower section 13. In the typical perforating operation the completed gun will be comprised of from twenty to thirty of such shaped charge sections.

As illustrated in the drawing, cable 11 is attached to top sub 14 which is retained to the upper charge section 12 by means of screw 15. O-rings 16 and 17 provide a fluid occlusive seal preventing well bore fluids from entering perforating gun 10. Section 12 of perforating gun 10 is joined to section 13 of the perforating gun by coupling sub 18. Screws 19 and 20 retain sections 12 and 13 to coupling sub 18 while O-rings 21–24 provide a fluid tight seal preventing fluid from entering the interior of perforating gun 10.

Now turning to upper section 12 of perforating gun 10, as representative of the construction of all the charge sections comprising a typical perforating gun, base member 25 provides a mounting surface for activator switch 26 and shaped charge 27. Conductors 28 and 29 connect activator switch 26 to cable 11 and provide firing current to section 12. Activator switch 26 is connected to blasting cap 30 by conductors 31 and 32 and further is connected to lower section 13 by conductor 33. Clip connector 34 allows for disconnecting of section 12 from section 13 so that perforating gun 10 can have shaped charge sections added or removed as the need arises and depending upon the configuration desired.

Blasting cap 30 is comprised of an aluminum sleeve approximately 3.97 centimeters in length and having an outside diameter of 0.75 centimeters. Blasting cap 30 contains ignition section 34, to which electrical conductors 31 and 32 are connected, and explosive charge section 35 which is approximately 2 grains of cyclonite. Ignition section 34 and explosive charge section 35 are separated within the aluminum sleeve of blasting cap 30 by approximately a 0.5 centimeters air gap 40. Ignition section 34 is retained by an aluminum facing with a small centrally aligned hole for collimating a flame provided by ignition section 34 upon a facing surface of explosive charge section 35. The facing surface of explosive charge section preferrably is constructed of a material such as azide. Two holes are punched in the side of the sleeve exposing air gap 40. Charge section 35 is crimp connected to primacord 36 which passes through the upper portion of shaped charge 27 and is terminated with end cap 37. Straps 38 and 39 secure primacord 36 and blasting cap 30 to base plate 25 and maintain primacord 36 in place on the upper portion of shaped charge 27. The above described blasting cap 30 can be a DuPont E-115 or similar model.

In the operation of a typical shaped charge section of perforating gun 10, current is supplied from a surface location to activator switch 26 by means of conductors 28 and 29. Provided all sections of perforating gun 10 located below section 12 have been fired, activator switch 24 will pass the firing current by way of conductors 31 and 32 to ignitor section 34 of blasting cap 30. Current passing through ignitor section 34 causes a flame of intense heat to be collimated through air gap 40 to the facing surface of explosive charge section 35 of blasting cap 30. The detonation of explosive charge section 35 ignites primacord 36 which in turn detonates shaped charge 27 resulting in a jet stream comprised of hot steam of high pressure gasses and high velocity particles to perforate the well casing and subsurface formations.

As previously stated, of primary concern is the danger that blasting cap 30 will be unintentionally ignited while in storage or shipment thereby causing the undesired detonation of shaped charge 27. The present invention provides method and apparatus for preventing such spurious detonation of shaped charges by assuring that explosive charge section 35 of blasting cap 30 is effectively isolated from ignition section 34.

To prevent the unintentional detonation of shaped charge 30, interrupter 41 is placed through a hole in base member 25 traversing air gap 40 located between ignitor section 34 and explosive charge section 35 of blasting cap 30, substantially perpendicular to the longitudinal axis of blasting cap 30, as illustrated in lower section 13 of perforating gun 10. Interrupter 41 is approximately 2.5 centimeters in length and 0.5 centimeters in width so that it can pass through the entire air gap portion 40 of blasting cap 30 and yet provides a snug fit within the air gap to prevent being dislodged by vibration of jarring. Interrupter 41 can be constructed of a hard rubber material or any material capable of blocking the high intensity flame emitted by ignitor section 34 from contacting explosive charge section 35. It is contemplated that interrupter 41 can be impregnated with a material, such as ammonium acetate, which will act to desensitize the temperature sensitive facing surface of explosive charge section 35. By placing an interrupter impregnated with such a desensitizing material adjacent explosive charge section 35, the explosive charge section can be made substantially insensitive to exposure to abnormally high temperature from an undesired source of flame.

Attached to interrupter 41 is lanyard 42 which passes through a small aperature 43 in the housing through to the exterior of perforating gun 10. The aperature can be a one-quarter inch threaded hole. When it is desired to arm perforating gun 10, lanyard 42 is pulled or jerked thereby dislodging interrupter 41 from its location in air gap 40. The clearing of air gap 40 serves to arm the shaped charge section 13 of perforating gun 10. By pulling lanyard 42 from each section comprising the complete perforating gun there is provided a quick and easy method of arming an entire perforating gun on location at the well. When all sections of perforating gun 10 have been made ready to fire, that portion of each lanyard protruding from the perforating gun 10 is severed and the aperture 43 is plugged and made fluid tight by the insertion of a threaded screw into the aperature 43.

Many modifications and variations besides those specifically mentioned may be made in the techniques and structures described herein and depicted in the accompanying drawing without departing substantially from the concept of the present invention. Accordingly, it should be clearly understood that the form of the invention described and illustrated herein is exemplary only, and is not intended as a limitation on the scope of the present invention.

The embodiments of the invention in which an exclusive property or privilege is claimed are defined as follows:

1. A shaped charge perforator apparatus, comprising:
   - a plurality of chambers with each chamber containing one or more shaped charge units;
   - a plurality of blasting caps, one of said blasting caps provided for each of said shaped charge units;
   - said blasting caps consisting of an explosive charge section having a heat sensitive portion and an ignitor section separated by a void zone therebetween;
   - an interrupter means removably disposed within said void zone thereby isolating said ignitor section from said explosive charge section, said interrupter means being impregnated with ammonium acetate for operably desensitizing said heat sensitive portion of said explosive charge section when said interrupter means is so disposed; and
   - means for removing said interrupter means from said void zone having a lanyard attached to said interrupter and passing to the exterior of said chamber for removing said interrupter from said void zone to thereby arm said perforator apparatus.

2. A perforating apparatus for use in completing a well, comprising:

an elongated tubular housing for traversing said well;

a plurality of shaped charge units within said housing;

a plurality of detonating means for detonating said shaped charge units, said detonating means having an ignitor section and an explosive charge section having a temperature sensitive portion;

means for temporarily disabling said detonating means between said detonating means and said shaped charge units to prevent cooperative operation thereof, said temporarily disabling means being an interrupter means impregnated with ammonium acetate for operably desensitizing said temperature sensitive portion of said explosive charge section when said interrupter means is exposed to the detonation of said ignitor section; and means for enabling said temporarily disabled detonating means, said means having a lanyard attached to said interrupter means and passing through an aperture in said housing for pulling said interrupter from said critical location thereby making said perforating apparatus ready for use in completing a well.

* * * * *